US008056241B2

(12) United States Patent
Davis et al.

(10) Patent No.: US 8,056,241 B2
(45) Date of Patent: Nov. 15, 2011

(54) UTILITY CUTTER

(75) Inventors: Raymond E. Davis, Heath, TX (US); Clifton Glenn Hampton, Burleson, TX (US)

(73) Assignee: ADCO Industries—Technologies, L.P., Dallas, TX (US)

( * ) Notice: Subject to any disclaimer, the term of this patent is extended or adjusted under 35 U.S.C. 154(b) by 567 days.

(21) Appl. No.: 12/250,158

(22) Filed: Oct. 13, 2008

(65) Prior Publication Data

US 2010/0088900 A1 Apr. 15, 2010

(51) Int. Cl.
*B26B 1/08* (2006.01)

(52) U.S. Cl. ..... 30/162; 30/335

(58) Field of Classification Search ..... 30/162, 30/335, 2, 151, 125, 330, 331, 329; 81/367
See application file for complete search history.

(56) References Cited

U.S. PATENT DOCUMENTS

| | | | | |
|---|---|---|---|---|
| 4,134,206 | A | 1/1979 | Beermann | |
| 4,180,908 | A | 1/1980 | Beermann | |
| 4,320,576 | A | 3/1982 | Beermann | |
| 4,683,656 | A | 8/1987 | Peyrot et al. | |
| 4,835,865 | A | 6/1989 | Knoop | |
| 4,837,931 | A | 6/1989 | Beermann | |
| 4,899,443 | A | 2/1990 | Beermann | |
| 5,203,085 | A | 4/1993 | Berns | |
| 5,384,963 | A | 1/1995 | Beermann | |
| 5,426,855 | A * | 6/1995 | Keklak et al. | 30/162 |
| 5,598,634 | A | 2/1997 | Berns | |
| 5,617,635 | A | 4/1997 | Berns | |
| 5,647,132 | A | 7/1997 | Berns | |
| 5,735,051 | A | 4/1998 | Berns | |
| 5,737,842 | A | 4/1998 | Freedman | |
| 5,890,294 | A | 4/1999 | Keklak et al. | |

(Continued)

FOREIGN PATENT DOCUMENTS

FR 2 893 525 A1 5/2007

OTHER PUBLICATIONS

Notification of Transmittal of the International Search Report and the Written Opinion of the International Searching Authority, or Declaration (3 pages); International Search Report (3 pages); and Written Opinion of the International Searching Authority (6 pages), mailed Jan. 29, 2010, for related international application PCT/US2009/060353.

(Continued)

*Primary Examiner* — Phong H Nguyen
(74) *Attorney, Agent, or Firm* — Fish & Richardson P.C.

(57) ABSTRACT

A utility cutter includes a housing, a blade and blade shuttle, a blade trigger, and a trigger lock. The blade and blade shuttle are enclosed within the housing in a retracted position. The blade is extended from the housing in an extended position. The blade trigger includes a cavity and is coupled to the housing. The blade shuttle is conveyed from the retracted position to the extended position when the blade trigger pivots from a rest position to an engaged position. The trigger lock includes a projection and is accessible at the exterior of the housing through the blade trigger. The trigger lock is coupled to the blade trigger and the projection is in contact with the stop pin when the blade shuttle is in the retracted position. The blade trigger is pivotable from the rest position to the engaged position when the projection is released from the stop pin.

20 Claims, 7 Drawing Sheets

U.S. PATENT DOCUMENTS

| | | | | |
|---|---|---|---|---|
| 6,070,326 | A | 6/2000 | Berns | |
| 6,148,520 | A | 11/2000 | Berns | |
| 6,233,832 | B1 | 5/2001 | Berns | |
| 6,532,670 | B1 | 3/2003 | Berns | |
| 6,550,144 | B1 | 4/2003 | Berns | |
| 6,553,673 | B2 | 4/2003 | Peyrot et al. | |
| 6,775,911 | B2 | 8/2004 | Tremblay | |
| 6,785,966 | B2 | 9/2004 | Berns | |
| 6,813,833 | B2 * | 11/2004 | Saunders et al. | 30/162 |
| 6,907,668 | B2 | 6/2005 | Polei | |
| 7,028,406 | B2 | 4/2006 | Polei | |
| 7,540,092 | B2 | 6/2009 | Polei | |
| 7,596,868 | B2 | 10/2009 | Berns | |
| 7,596,869 | B2 | 10/2009 | Berns | |
| 7,647,702 | B2 | 1/2010 | Polei | |
| 2004/0237312 | A1 | 12/2004 | Hernandez et al. | |
| 2008/0250651 | A1 * | 10/2008 | Davis et al. | 30/162 |
| 2008/0282547 | A1 | 11/2008 | Leger et al. | |

OTHER PUBLICATIONS

Notification Concerning Transmittal of International Preliminary Report on Patentability (2 pages); and Written Opinion of the International Searching Authority (5 pages), mailed Apr. 28, 2011, for related international application PCT/US2009/060353.

* cited by examiner

UTILITY CUTTER

TECHNICAL BACKGROUND

This disclosure relates to cutting rigid and semi-rigid materials, and more particularly, to cutting rigid and semi-rigid materials with a utility cutter including an integral trigger lock.

BACKGROUND

Utility cutters may be used to cut or slice a variety of materials, such as cardboard, corrugated board of varying thickness, rubber, lightweight plastic, or other packaging material. In order to cut or slice such material, the utility cutter may need to have a sharpened blade. Certain precautions may be used to protect or help protect a user from the sharpened blade. For example, a utility cutter may include guards that extend from the cutter alongside the sharpened blade, such that the guards substantially prevent an accidental injury to the user or other bystander. Further, a utility cutter may include a protective handle that encloses substantially all of a blade during periods of non-use. Utility cutters, however, may be actuated accidentally even during periods of storage or non-use. Accidental actuation of a utility cutter, therefore, may present a substantial hazard to the user, other persons, or valuable material.

Utility cutters are also often moved between and among many locations by users. Use of a utility cutter in a packaging or shipping environment, for example, may subject the utility cutter to periods of use and non-use at various locations, including such locations as vehicles or storage areas. Loss of utility cutters due to the transient nature of their use could mean a significant loss of economic value to an individual or business enterprise. Cost-efficient utility cutters, which effectively cut or slice a variety of material but do not represent a large outlay of economic resources, may have significant value to a business enterprise.

SUMMARY

In one general implementation, a utility cutter includes a housing, a blade connected to a blade shuttle, a shuttle spring, a blade trigger, and a trigger lock. The housing includes a blade aperture, a trigger aperture, and a stop pin. The blade and blade shuttle are substantially enclosed within the housing when the blade shuttle is in a retracted position, where the blade is extended from the housing when the blade shuttle is in an extended position. The shuttle spring is connected to the blade shuttle and adapted to convey the blade shuttle to the retracted position. The blade trigger includes a cavity and is pivotally coupled to the housing and accessible at an exterior of the housing through the trigger aperture. The blade shuttle is conveyed from the retracted position to the extended position when the blade trigger pivots from a rest position to an engaged position. The trigger lock includes a projection and is substantially enclosed within the cavity and accessible at the exterior of the housing through the blade trigger. The trigger lock is pivotally coupled to the blade trigger and the projection is in contact with the stop pin when the blade shuttle is in the retracted position. The blade trigger is substantially prevented from pivoting from the rest position to the engaged position when the projection is in contact with the stop pin and the projection is released from the stop pin upon rotation of the trigger lock. The blade trigger is pivotable from the rest position to the engaged position when the projection is released from the stop pin.

In some specific aspects of the utility cutter, the blade shuttle may be adapted to move from the extended position to a cutting position when the blade is engaged in a workpiece. The blade may extend further from the blade aperture in the cutting position than in the extended position. The shuttle spring may automatically convey the blade shuttle from the cutting position to the retracted position when the blade is disengaged from the workpiece. Additionally, the shuttle spring may be adapted to automatically convey the blade shuttle from the cutting position to the retracted position when the blade is disengaged from the workpiece when the blade trigger is in the engaged position. Further, the blade trigger may be adapted to pivot from the rest position substantially simultaneous to rotation of the trigger lock.

In certain specific implementations, the blade trigger may include a cleft and the trigger lock may include a notch. The notch may be adapted to engage the cleft upon rotation of the trigger lock and transfer rotational motion from the trigger lock to the blade trigger. The blade trigger may be adapted to rotate from the rest position to the engaged position when the notch engages the cleft. Additionally, the utility cutter may further include a transmission adapted to transfer a rotational force of the blade trigger as it rotates from the rest position to the engaged position to a lateral force, where the lateral force is directed to convey the blade shuttle from the retracted position to the extended position. In specific aspects, the blade shuttle may include a spring tongue and the blade trigger may further include a rail. The transmission may include at least one guide integrally formed in an interior surface of the housing; a lever coupled to the housing; and a drive arm coupled to the lever. The lever may include at least one lever pin adapted to move along the rail as the blade trigger rotates from the rest position. The drive arm may include a pin and a notch, where the pin is adapted to engage the guide and slide within the guide when the blade trigger rotates from the rest position. The notch is adapted to engage the spring tongue when the blade trigger rotates from the rest position and convey the blade shuttle from the retracted position to the extended position when the blade trigger rotates from the rest position to the engaged position. The spring tongue may be adapted to bend while engaged with the notch when the blade shuttle moves from the retracted position to the extended position. Further, the spring tongue may be adapted to disengage from the notch when the blade shuttle moves from the extended position to a cutting position. In some aspects, an angle between the drive arm and the lever may be between approximately 70 degrees and approximately 90 degrees In particular aspects of the utility cutter, the utility cutter may further include a spring post integral to the housing and a lever spring. The lever may be coupled to the housing via the spring post. The lever spring may be coupled to the spring post and the lever, where the lever spring is adapted to apply a torsional force to the lever and convey the blade trigger from the engaged position to the rest position via the transmission.

In certain embodiments, the shuttle spring may exert no force on the blade shuttle when the blade shuttle is in the retracted position. Further, the utility cutter may include a trigger spring, where the trigger lock may be in a locked position when the projection is in contact with the stop pin and an unlocked position when the projection is released from the stop pin. The trigger spring may urge the trigger lock from the unlocked position to the locked position. In some aspects, the trigger spring may be an integral spring extension of the trigger lock. In various aspects, the trigger spring may be a compression spring coupled to one of the trigger lock and the blade trigger. The trigger lock may be adapted to receive a compressive force to convey the trigger lock from the locked position to the unlocked position, where the blade trigger may be adapted to receive the compressive force to convey the blade trigger from the rest position to the engaged position.

The utility cutter may include a clip coupled to the housing. The clip may be coupled to either side of the housing. The housing may include a front housing edge at the blade aperture and a front contour. A plane tangential to the front housing edge and a plane tangential to a cutting edge of the blade may define a first obtuse angle. A plane tangential to the front contour and a plane tangential to the blade may define a second obtuse angle. The first obtuse angle and the second obtuse angle may define a compound angle of cut.

In certain aspects, the blade trigger may include a front portion and a back portion, where the front portion is nearest the blade aperture. The front and back portions may each define approximately one-half a length of the blade trigger. The trigger lock may be accessible at the exterior of the housing through the back portion of the blade trigger.

The blade of the utility cutter may include a mount hole and the blade shuttle may include an integral detent formed in a blade slot. The blade may be adapted to slide into the blade slot and engage the integral detent with the mount hole. The integral detent may include a leading edge and a back edge. The leading edge may be tapered from a base of the detent to a top of the detent, where the back edge may be substantially perpendicular to the blade shuttle. The blade may be adapted to engage the integral detent with the mount hole over the leading edge. The back edge may be adapted to substantially prevent decoupling of the blade from the blade shuttle.

Various implementations of a utility cutter according to the present disclosure may include one or more of the following features. The utility cutter may provide a safer cutting mechanism by substantially preventing accidental blade extensions. The utility cutter may provide a more ergonomic and comfortable fit for a user of the cutter. The utility cutter may include a locking mechanism that substantially prevents a blade from accidentally being extended from the cutter. Also, the locking mechanism of the utility cutter may allow for blade extension substantially simultaneous with unlocking. The utility cutter may automatically retract a blade used for cutting or slicing a workpiece into a protective handle when the blade becomes disengaged from the workpiece. Furthermore, the utility cutter may allow for a substantially constant force to extend a blade from a fully retracted position to a fully extended position. Additionally, the utility cutter may provide for a lightweight and disposable mechanism for cutting or slicing rigid or semi-rigid materials.

Various implementations of a utility cutter according to the present disclosure may also include one or more of the following features. The utility cutter may allow for less energy and effort to be utilized when slicing or cutting material through a compound angle of cut. The utility cutter may allow for reduced friction on a blade of the cutter thereby increasing the life of the blade. The utility cutter may allow for reduced friction on a blade of the cutter thereby allowing for a cleaner cut of a rigid or semi-rigid workpiece. The utility cutter may utilize a friction force between a blade of the cutter and a workpiece to allow for automatic retraction of the blade into a retracted position in the cutter. Also, the utility cutter may ensure that a mechanical action of the cutter experiences minimal malfunctions by reducing contaminants from entering the cutter. Additionally, the utility cutter may include a two-piece assembly housing that prevents user access to an interior of the assembly housing in order to avoid internal contamination. The utility cutter may include a two-piece assembly housing held together by security screws requiring specialized tooling to access the interior of the assembly housing, thereby preventing or minimizing internal contamination and malfunction. The utility cutter may allow a user to more comfortably cut rigid or semi-rigid material without substantially injury. The utility cutter may be actuated with approximately 75% less force than typical utility cutters. The utility cutter may also substantially prevent injuries or workplace hazards due to loose cutting blades. The utility cutter may also more easily be carried or otherwise transported in a user's pocket or secured to an article of clothing.

These general and specific aspects may be implemented using a device, system or method, or any combinations of devices, systems, or methods. The details of one or more implementations are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

The figures and following description illustrate and explain a utility cutter 10, which may be used to cut rigid or semi-rigid materials, such as, for example, corrugated board, cardboard or other paper products, rubber, plastic, Styrofoam, or any other appropriate material. The utility cutter 10 is typically a handheld device operated by either a left-handed or right-handed user with equal ease. In some implementations, the utility cutter 10 allows the user to carry, transport, or otherwise handle the cutter 10 in a back position, whereby a sharpened blade of the cutter 10 is locked in a retracted position within a protective housing or handle. The user may, as appropriate, set the cutter 10 into an unlocked position via an integral trigger lock within a blade trigger. Further, the user may, substantially simultaneous to placing the utility cutter 10 into the unlocked position, easily and ergonomically actuate the blade trigger to extend the sharpened blade from the protective handle. Once the user finishes cutting the material as desired, the user may disengage the blade from the material. Once disengaged, the blade may be automatically retracted within the protective handle by a spring force to ensure that the blade is no longer exposed and able to cause injury to the user or other person, and/or the material previously cut. This automatic retraction of the blade may occur regardless of whether the blade trigger remains actuated by the user.

Figure 1:
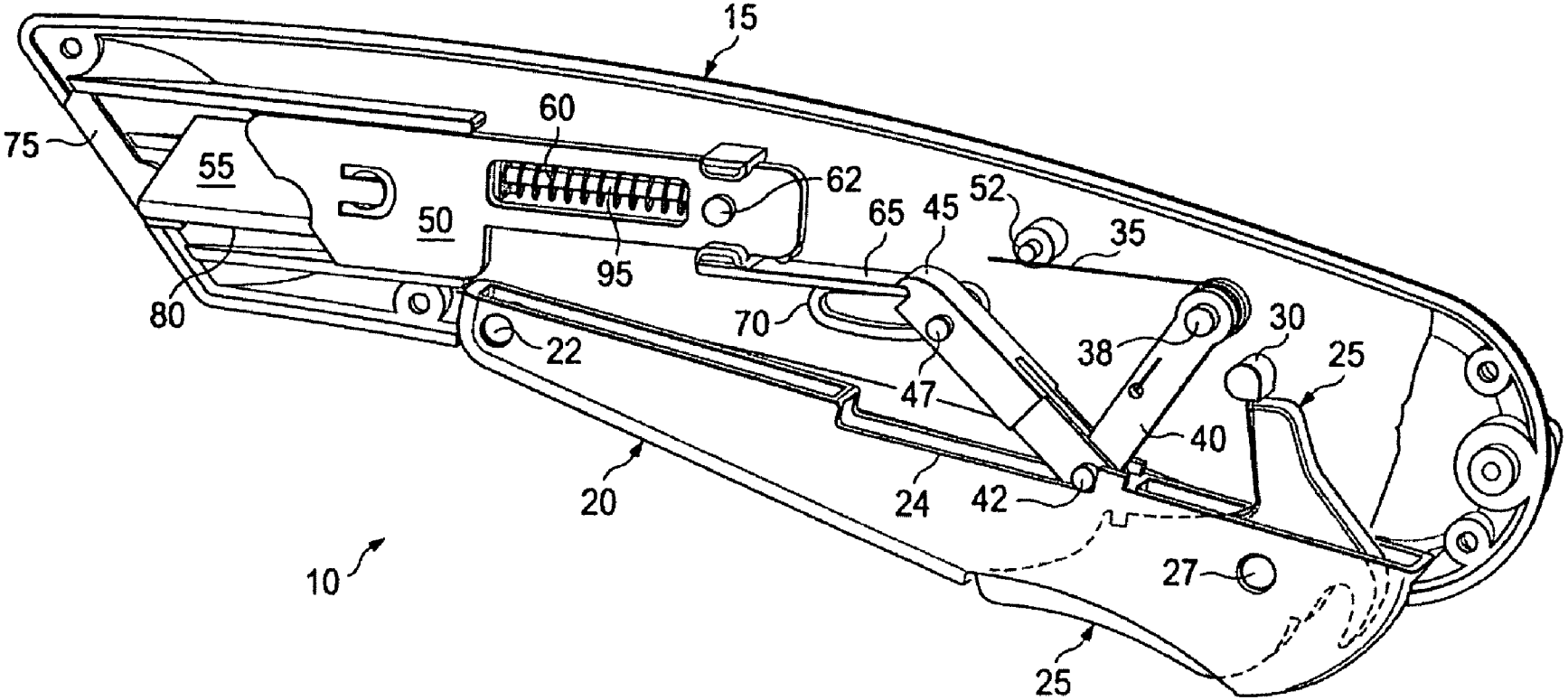
FIG. 1 illustrates one implementation of a utility cutter according to the present disclosure in a back position.

FIG. 1 illustrates one implementation of the utility cutter 10 according to the present disclosure in a back position.

Utility cutter 10 includes, among other components, a housing 15, a blade trigger 20, a trigger lock 25, a lever 40, a drive arm 45, a blade shuttle 50, and a blade 55. Generally, the utility cutter 10 allows for a utility knife with an integral trigger lock 25 within the blade trigger 20, which prevents the blade 55 from extending from the housing 15 while the cutter 10 is in a back position prior to activation (e.g., rotation) of the trigger lock 25. In some implementations, the trigger lock 25 may prevent accidental extension of the blade 55, thereby preventing a safety hazard for a user of the cutter 10 or others.

The housing, or handle, 15, of the utility cutter 10 encloses at least a portion of the components of the cutter 10 within a protective enclosure. Typically, the housing 15 may be manufactured as a stamped and extruded molded case (e.g., GF nylon), but alternatively, may be made of any appropriate rigid or semi-rigid material. For example, the housing 15 may be made from aluminum or steel, such as stainless steel, in certain implementations. The housing 15, however, may be made of a lightweight and cost efficient material such that the utility cutter 10 may be disposed of upon its end of life without significant economic loss.

Further, the housing 15, generally, may be a two-piece housing such that identical or substantially identical halves of the housing may be coupled together to enclose the components of the utility cutter 10. As a two-piece configuration, the housing 15 may be coupled together through mechanical means, such as screws, rivets, or a snap fit, or through adhesive material. In some aspects, the two halves of the housing 15 may be coupled together using specialty screws, such that a user of the utility cutter 10 may require a special tool to decouple the halves of the housing 15.

The housing 15 includes a blade aperture 75, which allows the blade 55 to extend from the housing 15 when the cutter 10 is actuated. In certain implementations, such as when the housing 15 includes a two-piece design, the blade aperture 75 may be formed at a distal end of the cutter 10 when the two halves of the housing 15 are coupled together. Further, the housing 15 includes an aperture along a bottom side of the housing 15 through which the blade trigger 20 may extend. Additionally, in some aspects, the housing 15 may include one or more integral protrusions extending from an interior wall of the housing 15 into the cavity formed by the two-piece enclosed housing 15. For example, in some aspects, the housing 15 may include a stop pin 30, a spring post 38, a body pin 52, and a slot 70. In some implementations of the housing 15, each half of the housing 15 may include a stop pin 30, a spring post 38, a body pin 52, and a slot 70. In such implementations, for example, the two stop pins 30, the two spring posts 38, and the two body pins 52 may meet in approximately the middle of the cavity formed in the housing 15. Alternatively, two stop pins 30 and two body pins 52 may be included that meet in approximately the middle of the cavity formed in the housing 15, while a single spring post 38 and a single slot 70 are included. In some implementations of the utility cutter 10, the stop pin 30 and the spring post 38 may be combined into one protrusion extending into the cavity and incorporating the functions described herein for these components.

Figure 3:
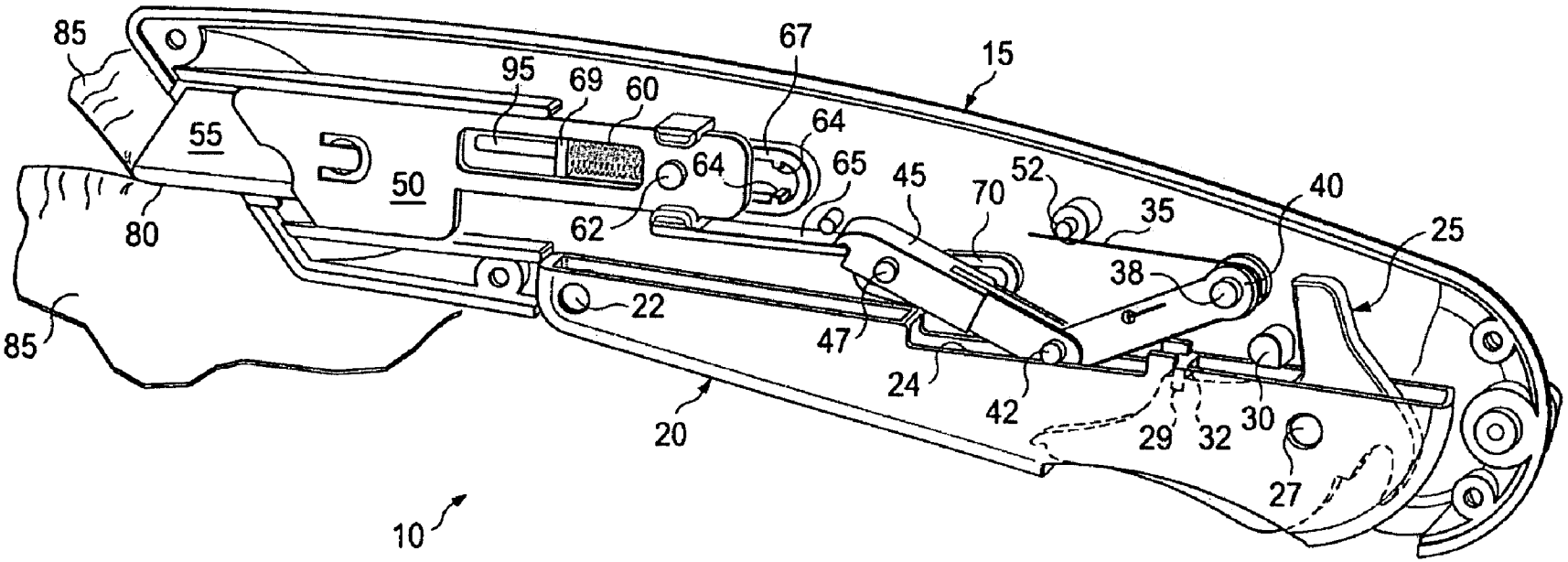
FIG. 3 illustrates one implementation of a utility cutter according to the present disclosure in an actuated position.

Continuing with FIG. 1, the blade trigger 20 is pivotally coupled to the housing 15 at a trigger pivot 22, thereby allowing the blade trigger 20 to rotate about the pivot 22 upon a compressive force being applied to the blade trigger 20 by the user of the utility cutter 10. Typically, the blade trigger 20 is ergonomically shaped to allow for a comfortable grip by the user of the cutter 10. In the back position, as shown in FIG. 1, the blade trigger 20 may extend further from the housing 15 than when the cutter 10 is in an actuated position (e.g., as shown in FIG. 3). In some implementations, the blade trigger 20 includes an internal cavity, which is hollow to allow, for example, the trigger lock 25 to be seated within the blade trigger 20. Further, the blade trigger 20 may also include one or more rails 24 that form a recessed portion along a top edge of the blade trigger 20. The rails 24 may be formed in a specified portion of the blade trigger 20, and typically, are formed in a middle third along the length of the top edge of the blade trigger 20. In some implementations, the length of the rails 24 may restrict a distance in which the blade 55 may extend from the housing 15 of the utility cutter 10 (i.e., the "throw" of the blade 55).

The trigger lock 25 is pivotally coupled to the blade trigger 20 at one or more lock pivots 27, and is substantially seated within the blade trigger 20. Generally, a portion of the trigger lock 25 extends through an aperture formed in the blade trigger 20 and to the exterior of the housing 15, thereby allowing access to the trigger lock 25 by the user of the utility cutter 10. In the back position, at least a portion of the trigger lock 25 is in contact with the stop pin 30. For example, as illustrated in FIG. 1, the trigger lock 25 includes an extended projection with a pointed end such that the projection overlaps and is in contact with the stop pin 30. Additionally, the trigger lock 25 may further include, in some aspects, an integral spring extension curved to fit within and apply a spring-like force against the blade trigger 20. As further illustrated in FIG. 1, this integral spring extension may extend from the trigger lock 25 and, in some aspects, may help ensure that the trigger lock 25 returns to the back position when the blade trigger 20 is released. Alternatively, a separate compression-type spring may be secured to the trigger lock 25 to help urge the trigger lock 25 to the back position when the blade trigger 20 is released, as more fully described in FIG. 6.

In some implementations of the utility cutter 10, the trigger lock 25 is positioned such that the lock 25 extends through an aperture formed in a back half of the blade trigger 20 furthest from the blade aperture 75 to the exterior of the housing 15. In such implementations, the user of the utility cutter 10 may grip the blade trigger 20 and the trigger lock 25 simultaneously, with one or more fingers positioned on the trigger lock 25. For example, the user may naturally and ergonomically grip the utility cutter 10 such that the user's third and/or fourth fingers may be positioned on the trigger lock 25 while the user's first and second fingers are positioned on the front half of the blade trigger 20. The user's thumb is typically placed around a top edge of the housing 15 during operation and handling of the utility cutter 10. As explained in more detail with reference to FIGS. 2-4, upon a natural gripping movement by the user, the utility cutter 10 may be unlocked and actuated, thereby extending the blade 55 from the housing 15.

Lever 40 is an elongated member that is coupled at one end to the housing 15 via the spring post 38. An opposite end of the lever 40 includes one or more lever pins 42 protruding from the lever 40. In some implementations, the lever 40 extends into the cavity of the blade trigger 20 while lever pins 42, extending from either side of the lever 40, are seated upon the rails 24 of the blade trigger 20. In the back position, in the implementation illustrated in FIG. 1, the lever pins 42 are seated on the rails 24 at a position furthest from the blade aperture 75.

A lever spring 35 is coupled to the lever 40 at one end through a small aperture in the body of the lever 40 and is wound around the spring post 38. A free end of the lever spring 35 is set against the body pin 52, thereby providing a spring force against the lever 40. The lever spring 35, therefore, acts to force the lever 40 into the back position shown in FIG. 1, such that the lever pins 42 are seated against a back end of the rails 24 furthest from the blade aperture 75. Lever spring 35, in some implementations, is a wire spring made of spring steel.

Figure 2:
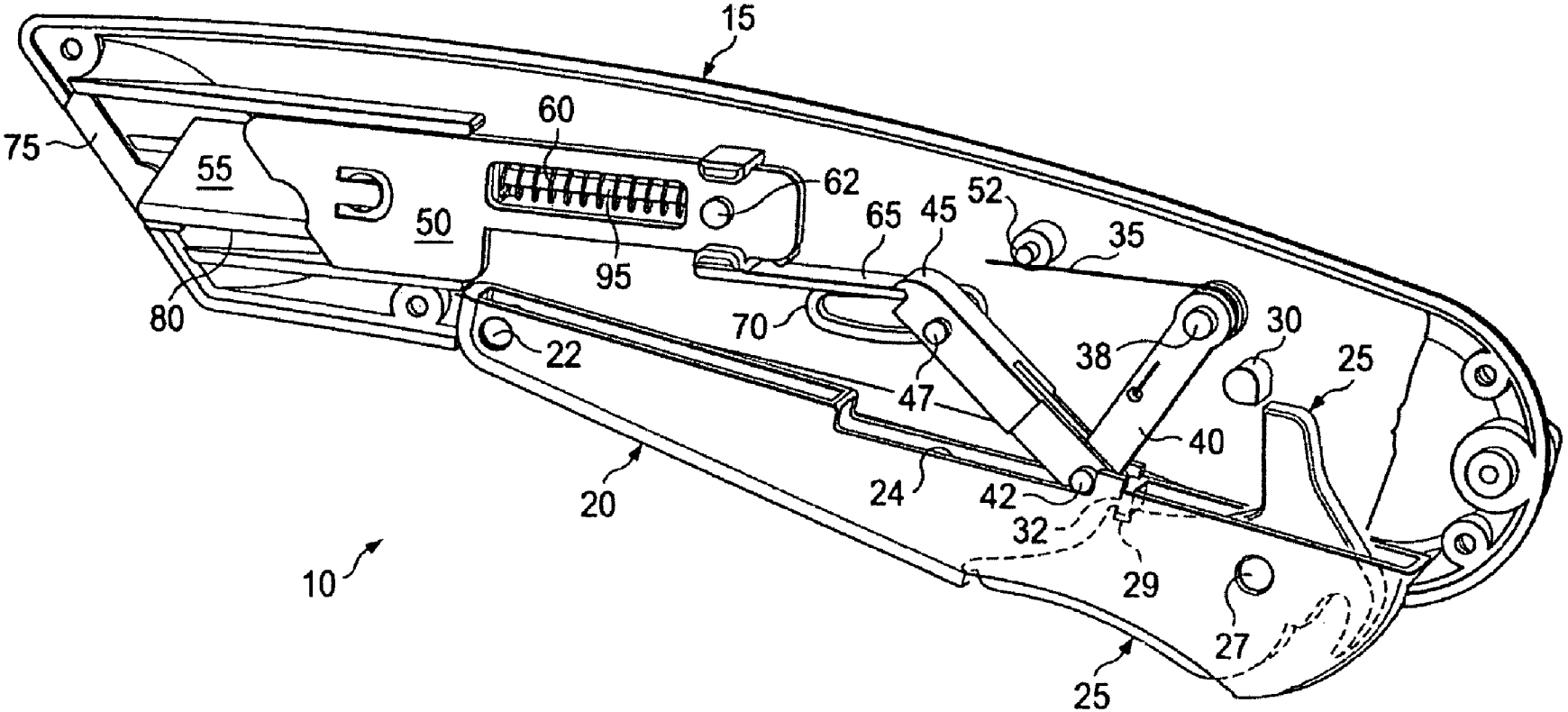
FIG. 2 illustrates one implementation of a utility cutter according to the present disclosure in an unlocked position.

In the implementation shown in FIGS. 1 and 2, the drive arm 45 may include a slotted end coupled to the lever 40 via the lever pins 42 and a notched end opposite the slotted end that, when the utility cutter 10 is in the back position, receives a spring tongue 65 coupled to the blade shuttle 50. The drive arm 45, in some aspects, includes two substantially circular apertures, which fit over the lever pins 42 on either side of the lever 40. Like the lever 40, the end of the drive arm 45 that is coupled to the lever 40 may extend into the cavity of the blade trigger 20. The drive arm 45 may also include one or more guide pins 47 extending from the sides of the drive arm 45. The guide pins 47 may, for example, be insertable into corresponding slots 70 formed in the interior walls of the two-piece housing 15. In some implementations, the slots 70 may be designed with a specific length to control the "throw" of the blade by restricting the longitudinal movement of the guide pins 47 in the slots 70. In the back position shown in FIG. 1, the guide pins 47 are positioned at a back end of the slots 70 furthest from the blade aperture 75.

With regards to the drive arm 45, in some implementations of the utility cutter 10, this component may be set between approximately 70 and 90 degrees (e.g., 82 degrees) from the lever 40 when the utility cutter 10 is in the back position shown in FIG. 1. If the angle between the drive arm 45 and the blade trigger 20 is, for example, less than approximately 70-90 degrees, the blade trigger 20 may become substantially perpendicular to the rails 24 of the blade trigger 20, thereby causing the drive components (e.g., the lever 40 and the drive arm 45) to lock and substantially preventing rotation by the blade trigger 20. In some aspects, therefore, extension of the blade shuttle 50 from its retracted position may be substantially prevented.

Continuing with the implementation of FIG. 1, the blade shuttle 50 is coupled to the blade 55 at one end of the shuttle 50 and the spring tongue 65 at the other end of the shuttle 50. The spring tongue 65 is, typically, substantially planar and rectangular in shape and made of a pliable material, thereby allowing the spring tongue 65 to bend during operation of the utility cutter 10. The blade shuttle 50 may further include one or more integral shuttle pins 62 extending from either side of the shuttle 50. Turning briefly to FIG. 3, the shuttle pins 62 may be inserted into a shuttle guide 64 formed into the interior wall of the housing 10. The shuttle guide 64, typically, may be a channel-shaped extrusion with one or more ridges 67 formed transversely across the guide 64 at a rounded end. The guide 64 may also include a closed square end opposite the rounded end and closest to the blade aperture 75, including a small hole through which the spring rod 95 may be inserted. Thus, the spring rod 95 and shuttle spring 60 may be substantially enclosed within the shuttle guide 64 with the spring rod 95 protruding through the square closed end of the guide 64. The shuttle spring 60 may thus be constrained within the shuttle guide 64 between the ridges 67 and the square closed end. In some implementations, the shuttle pins 62 may have substantially no contact with the spring rod 95 and shuttle spring 60 when the utility cutter 10 is in the back position. Thus, the shuttle spring 60 may exert no force on the blade shuttle 50 when the utility cutter 10 is in the back position.

As more fully explained with reference to the implementation show in FIGS. 2-5, a shuttle pin 62 pushes the spring rod 95 forward toward the blade aperture 75 upon extension of the blade 55 from the housing 15, thereby placing the shuttle spring 60 into compression. In the back position shown in FIG. 1, however, the blade shuttle 50 is fully retracted into the housing 15 such that the blade 55 is also fully enclosed within the housing 15.

Figure 5:
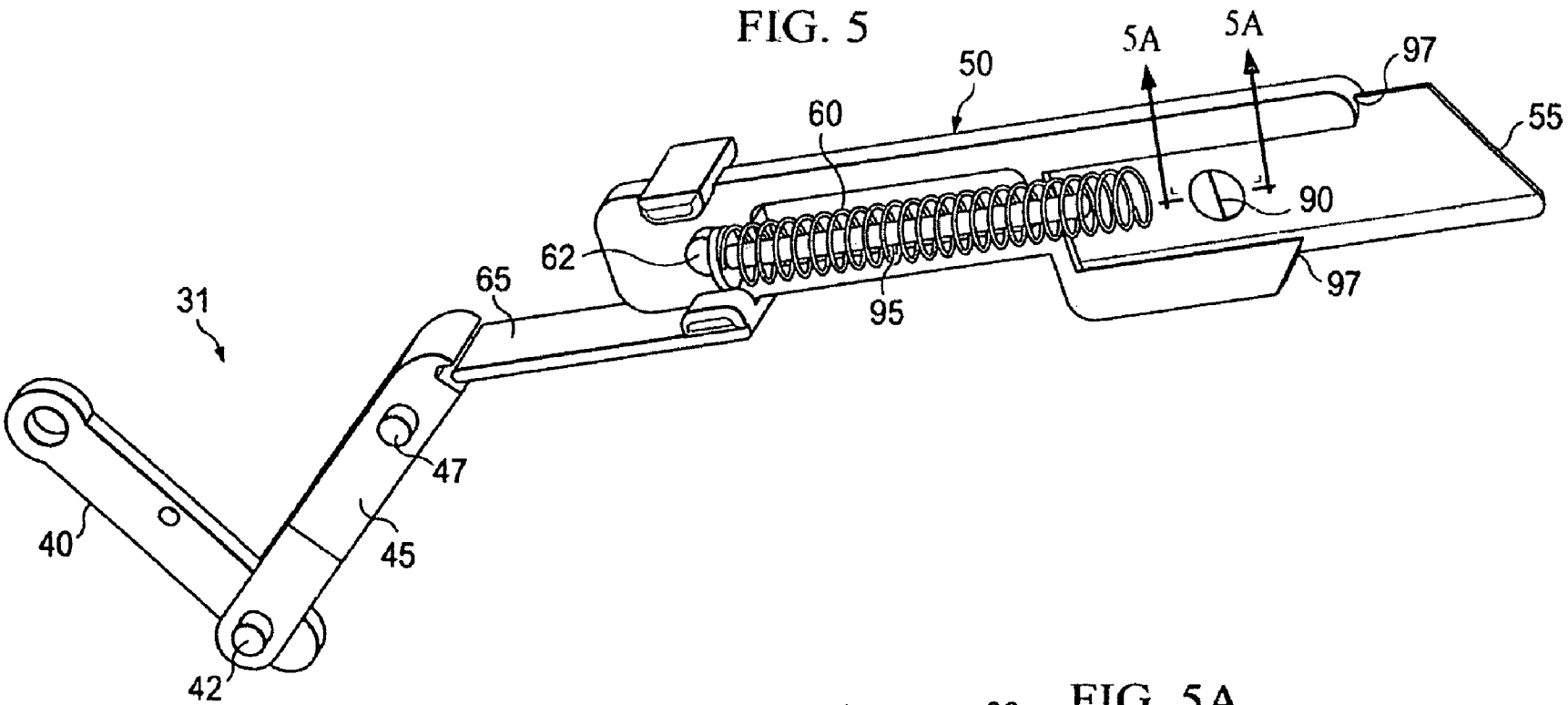
FIGS. 5 and 5A illustrate one implementation of a transmission of a utility cutter according to the present disclosure.

Blade 55 is typically formed of steel with a sharpened cutting edge 80 and a rounded safety point at the leading end of the cutting edge 80. Further, the blade 55 typically includes a trapezoidal end and a substantially rectangular end, as shown in FIG. 5. Alternatively, the blade 55 may be a trapezoidal-shaped blade. In some implementations, the blade 55 may be segmented such that the blade 55 may be removed when no longer usable (e.g., dulled or broken by use). The blade 55, however, may be disposable such that upon the end of its useful life, a replacement blade may be inserted into the utility cutter 10, or a replacement utility cutter 10 may be used.

The blade 55 may be coupled to the blade shuttle 50 through mechanical means, such as a screw or rivet, or alternatively, may be attached to the blade shuttle 50 through adhesive means. In some implementations of the utility cutter 10, as more fully shown in FIG. 5, the blade 55 may be detachably coupled to the blade shuttle 50 via a spring detent 90 integrally formed into the shuttle 50.

FIG. 2 illustrates the utility cutter 10, according to one implementation, in an unlocked position. When the user of the utility cutter 10 determines that the blade 55 should be extended from the housing 15, the cutter 10 may first be unlocked. In order to place the cutter 10 into its unlocked position, the trigger lock 25 may be rotated relative to the blade trigger 20 such that the trigger lock 25 is no longer in contact with the stop pin 30.

As shown in the implementation of FIG. 2, upon a compressive force being applied to the trigger lock 25 in the back position, the trigger lock 25 may be rotated clockwise about the lock pivot 27. Upon rotation, the projection of the trigger lock 25 slides past the stop pin 30 such that the trigger lock 25 is no longer in contact with the stop pin 30. The utility cutter 10 is thereby placed into the unlocked position. If the user, however, applies a compressive force only to the blade trigger 20 before the utility cutter 10 is unlocked, the utility cutter 10 will remain in the back position shown in FIG. 1. For example, if a compressive force is applied to the blade trigger 20 only, the blade trigger 20 will attempt to rotate counterclockwise about the trigger pivot 22. The trigger lock 25, however, remains in contact with the stop pin 30, thereby preventing the blade trigger 20 from substantially any rotation and preventing substantially any extension of the blade shuttle 50 and blade 55.

Continuing with the implementation shown in FIG. 2, in some aspects, the stop pin 30 may be substantially teardrop in shape with a pointed end directed away from the blade aperture 75. In such implementations, the trigger lock 25 may more easily slide past the stop pin 30 upon the compressive force being applied to the trigger lock 25. The stop pin 30 and the trigger lock 25, however, may be any appropriate shapes that substantially prevent rotation of blade trigger 20 without a prior or substantially simultaneous rotation of the trigger lock 25. For example, the larger in circumference the stop pin 30, the greater the interference that may occur between it and the trigger lock 25. Thus, the size and shape of the stop pin 30 may correlate to the amount of force required to rotate the trigger lock 25 from the back position to the unlocked position.

As further shown in FIG. 2, trigger lock 25 may also include a recess 29 formed in a top edge of the trigger lock 25. The recess 29 may be formed such that as the trigger lock 25 rotates clockwise about the lock pivot 27, the recess 29 may receive a shoulder 32 integrally formed in the blade trigger 20. Thus, continued compressive force placed on the trigger lock 25 may be transferred to the blade trigger 20 as the recess 29 receives the shoulder 32, thereby rotating the blade trigger 20 counterclockwise into an actuated position, more fully explained with reference to FIG. 3.

The implementation reflected in FIG. 3 illustrates the utility cutter 10 in an actuated position. Subsequent to the utility cutter 10 being placed in the unlocked position as illustrated in FIG. 2, the cutter 10 may be placed into the actuated position. In some implementations, the user may place the utility cutter 10 into the actuated position in multiple fashions. For example, after the compressive force rotates the trigger lock 25 such that the stop pin 30 no longer impedes the rotation of the blade trigger 20, additional compressive force on the trigger lock 25 may, as explained above, cause the recess 29 to engage the shoulder 32 of the blade trigger 20. The additional compressive force on the trigger lock 25 is thus transmitted to the blade trigger 20, thereby causing rotation of the blade trigger 20 about the trigger pivot 22. As another example, a compressive force applied to the blade trigger 20 subsequent to the utility cutter 10 being placed in the unlocked position (in place of or in addition to the additional compressive force being applied to the trigger lock 25) may cause rotation of the blade trigger 20 about the trigger pivot 22.

As shown in FIG. 3, rotation of the blade trigger 20 about the trigger pivot 22 moves the blade shuttle 50 from the retracted position to the extended position, thereby extending the blade 55 through the blade aperture 75. As the blade trigger 20 rotates, the lever pins 42 slide forward along the rails 24. The drive arm 45, coupled to the lever 40 at the lever pins 42, is thereby pushed forward toward the blade aperture 75. The guide pins 47 move forward within the slots 70, which may be, in some aspects, positioned such that movement of the guide pins 47 is substantially parallel to the movement of the blade shuttle 50 as it moves from the retracted position to the extended position.

The forward movement of the drive arm 45 may be transferred to the blade shuttle 50 through the spring tongue 65 engaged with the notch end of the drive arm 45. The spring tongue 65 may, in some aspects, bend downward as the drive arm 45 exerts a forward-directed force on the blade shuttle 50, but, typically, stays engaged with the drive arm 45 while the blade shuttle 50 moves from its retracted position to its extended position.

As shown in FIG. 3, as the blade shuttle 50 is pushed from its retracted position to its extended position, the shuttle pin 62 slides within the shuttle guide 67, past the ridges 64, and engages the spring rod 95. In some implementations, as shown in FIG. 5, the spring rod 95 includes a flattened end, which the shuttle pin 62 engages as it moves forward. As the spring rod 95 is pushed forward by the blade shuttle 50, the shuttle spring 60 becomes compressed, thereby exerting a force against the spring rod 95 urging the blade shuttle 50 into its retracted position. Continuing with FIG. 3, as the blade shuttle 50 moves from the retracted position to the extended position, the blade 55 extends from the housing 15 through the blade aperture 75 and may engage a workpiece 85 (e.g., cardboard, paper, corrugated board, plastic, rubber).

In some implementations of the utility cutter 10, an angle between the drive arm 45 and the lever 40 may be between approximately 70 degrees and approximately 90 degrees when in the retracted position. An initial force necessary to begin rotation of the blade trigger 20 and overcome the inertia of the components of the cutter 10 in the back position may therefore be substantially equal to a force required to extend the blade 55 from the housing 15 once the components of the cutter (e.g., blade trigger 20, lever 40, drive arm 45, and blade shuttle 50) are set in motion. For example, the initial force required to rotate the blade trigger 20 may be approximately 8 ounces while the force required to extend the blade 55 may be between approximately 7-8 ounces. In such fashion, the user of the utility cutter 10 may expend less energy in actuating the cutter 10, thereby allowing for more ease of use and less chance of injury from use of the cutter 10.

Figure 4:
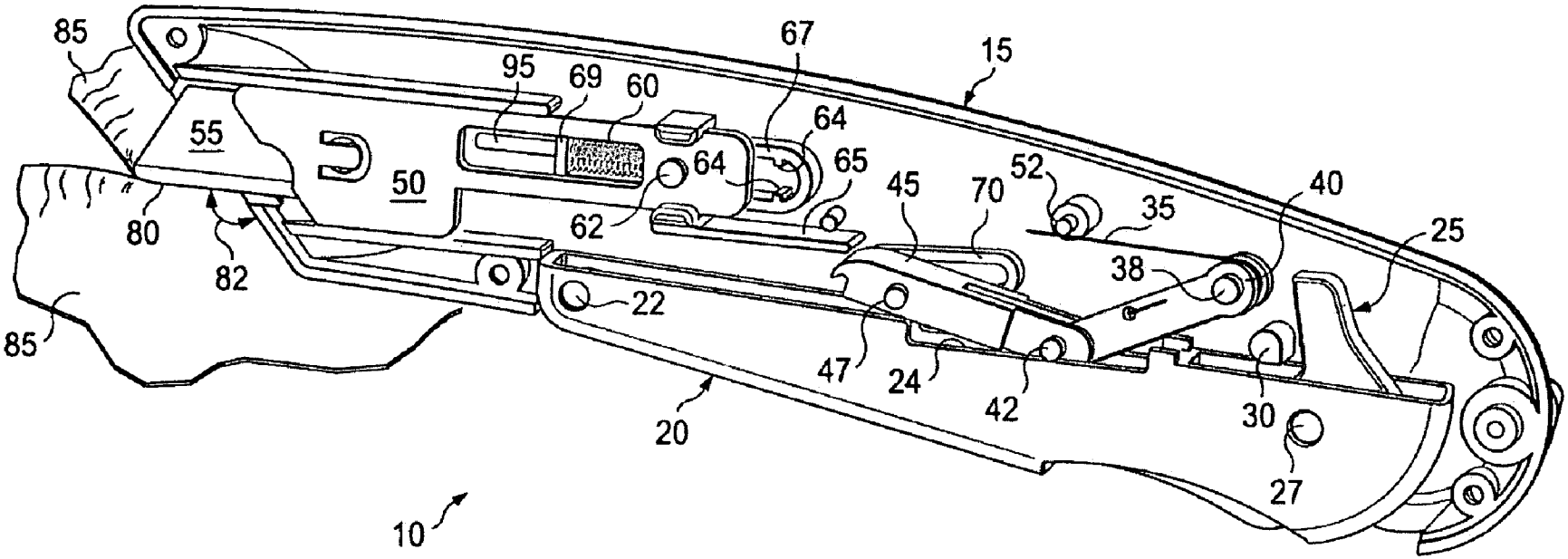
FIG. 4 illustrates one implementation of a utility cutter according to the present disclosure in a cutting position.

The implementation shown in FIG. 4 illustrates the utility cutter 10 in a cutting position with the blade 55 engaged in the workpiece 85. Once the blade 55 engages the workpiece 85, a frictional force between the workpiece 85 and the blade 55 extends the blade 55 a short distance further from the blade aperture 75. For example, the blade 55 may be extended approximately one-sixteenth of an inch when engaged with the workpiece 85. The blade shuttle 50, coupled to the blade 55, is thereby extended from its extended position to a cutting position by substantially the same distance. Once extended into the cutting position, the spring tongue 65 may be disengaged from the drive arm 45.

In one implementation, once the blade 55 become disengaged from the workpiece 85 and the frictional force no longer exists between the workpiece 85 and the blade 55, the shuttle spring 60 uncoils to automatically retract the blade shuttle 50 from its cutting position to its retracted position. More specifically, the shuttle spring 60 is compressed as the blade shuttle 50 moves from the retracted position to the extended position. When the frictional force on the blade 55 becomes less than the spring force of the shuttle spring 60, the spring 60 exerts the spring force on the shuttle pin 62 via the spring rod 95. The spring force exerted on the shuttle pin 62 by the shuttle spring 60 may be transferred to the blade shuttle 50, thereby returning the blade shuttle 50 to its retracted position.

In some aspects of the utility cutter 10, the blade shuttle 50 may return to its retracted position when the blade trigger 20 is actuated. As shown in the implementation of FIG. 4, when the spring tongue 65 becomes disengaged from the drive arm 45, the spring tongue 65 may return from a bent position to a substantially horizontal position. Thus, when the blade 55 becomes disengaged from the workpiece 85, the blade shuttle 50 may return to its retracted position without substantially any interference between the spring tongue 65 and the drive arm 45. Once the blade shuttle 50 is in the retracted position, if the blade trigger 20 is released by the user, thereby moving the trigger 20 from the actuated position to an unactuated position, the drive arm 45 may return and reengage the spring tongue 65. More specifically, upon release of the blade trigger 20 by the user, the lever spring 35 acts to return the lever 40 and the drive arm 45 to their respective positions shown in FIG. 1. For example, the lever 40 rotates counterclockwise about the spring post 38, thereby sliding the lever pins 42 backwards along the rails 24. As the lever pins 42 slide backward, the drive arm 45 may be pulled backward while the guide pins 47 remain in the slots 70. Further, as the blade trigger 20 rotates clockwise into its unactuated position, the trigger lock 25 may reengage the stop pin 30, thereby placing the utility cutter 10 into the back position (shown in FIG. 1).

Alternatively, if the blade trigger 20 is in the unactuated position (as shown in FIG. 1) when the blade 55 becomes disengaged from the workpiece 85, the spring tongue 65 may move freely back upon retraction of the blade shuttle 50 until the tongue 65 reengages the drive arm 45. Thus, the blade shuttle 50 may be automatically retracted from the cutting position regardless of whether the blade trigger 20 is in the actuated position or the unactuated position.

Figure 7:
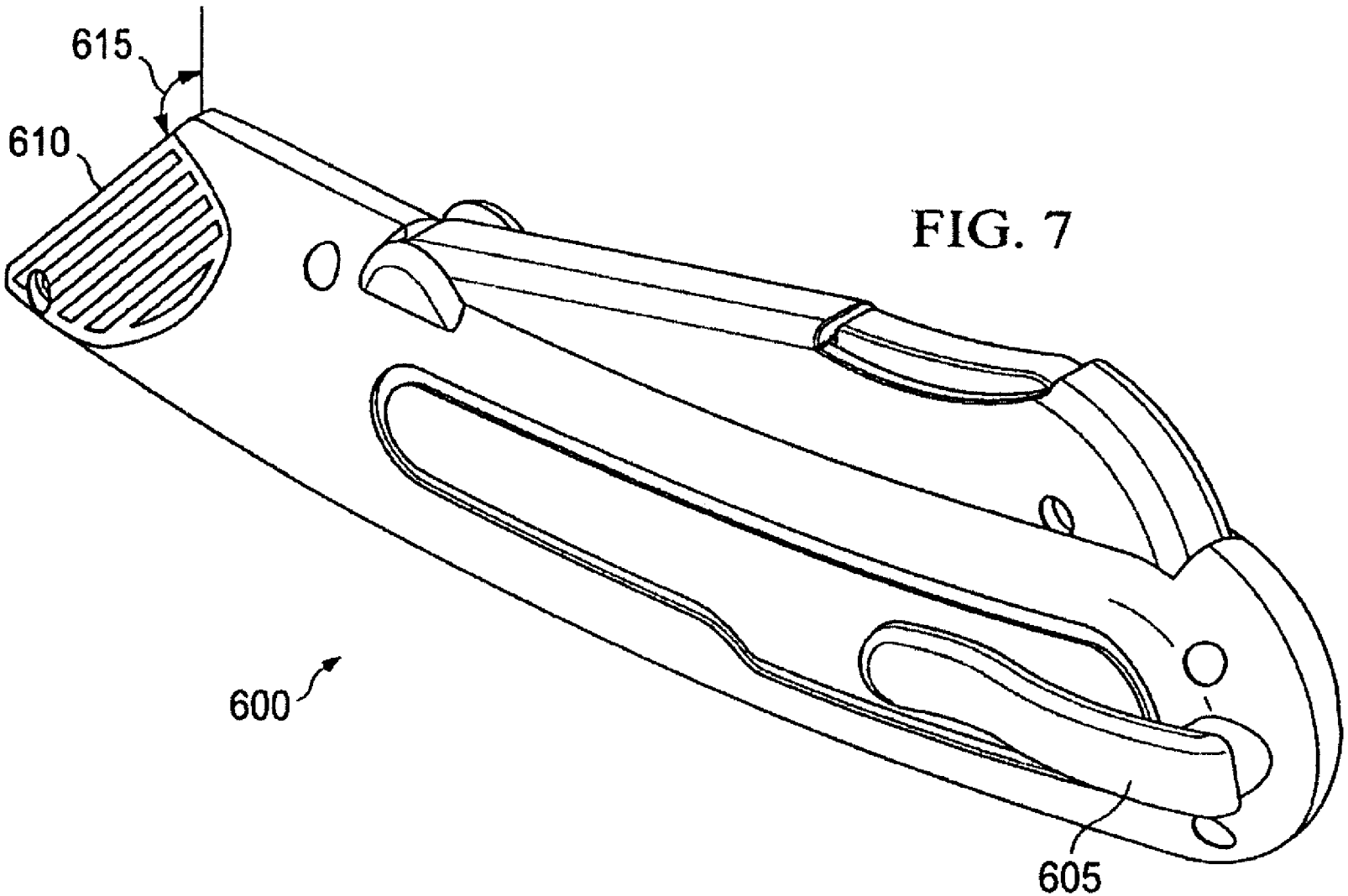
FIG. 7 illustrates another implementation of a utility cutter according to the present disclosure.

Continuing with the implementation of FIG. 4, a first cutting angle 82 is illustrated between the cutting edge 80 of the blade 55 and the blade aperture 75 of the housing 15. The first cutting angle 82 may be an obtuse angle (e.g., greater than 90 degrees). Turning briefly to FIG. 7, the utility cutter 10 may also include a housing contour 610, which creates a second cutting angle 615 between an extension plane of the blade 55 and the housing contour 610. The second cutting angle 615, as shown in FIG. 7, may also be an obtuse angle (e.g., greater than 90 degrees). Taken together, the first cutting angle 82 and the second cutting angle 615 may create a compound angle of cut of the blade 55, thus allowing the blade 55 to more easily slice a material, such as the workpiece 85. In some aspects, the compound angle of cut may reduce the energy and labor required to make a cut with the utility cutter 10 by, for example, providing a falling edge such that cut material may more easily be removed and fall off the edge.

FIG. 5 illustrates one implementation of a transmission 31 of the utility cutter 10 according to the present disclosure. The transmission 31 includes, for example, the lever 40, including the lever pins 42, and the drive arm 45. Generally, the transmission 31 converts rotational movement of the blade trigger 20 into lateral movement of the blade shuttle 50. FIG. 5 further illustrates another view of the blade shuttle 50, the blade 55, the shuttle spring 60, and the spring rod 95. As illustrated in FIG. 5, the spring rod 95 may be inserted through the shuttle spring 60. The spring rod 95 may protrude through a hole in wall 69 of the shuttle guide 67 while the shuttle spring 60 is enclosed within the guide 67 (as shown in more detail in FIGS. 3 and 4).

Figure 5A:
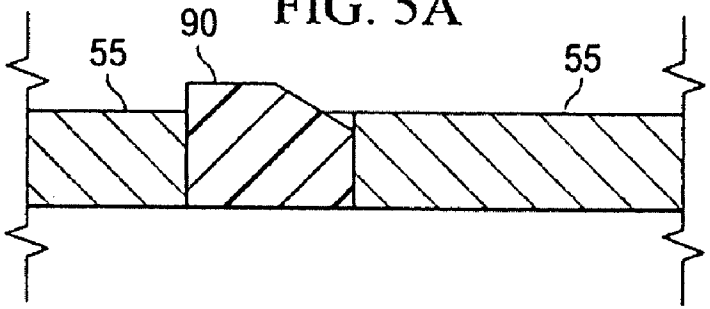

FIG. 5 further illustrates a spring detent 90 that may be integrally formed in the blade shuttle 50. Generally, the spring detent 90 provides a coupling means by which the blade 55 may be detachably coupled to the blade shuttle 50, allowing the blade 55 to be removed when necessary while securing the blade 55 to the blade shuttle 50 during use of the utility cutter 10. In some implementations, the spring detent 90 may include a tapered front profile, as shown in the sectional view of FIG. 5A. In such implementations, the blade 55 may be coupled to the blade shuttle 50 by ramping the blade 55 up the tapered front profile until an aperture in the blade 55 fits over the spring detent 90. The spring detent 90 also may include a square back profile that allows the blade 55 to secure to the blade shuttle 50 even under a tensile force applied by, for example, use of the blade 55 in cutting a workpiece 85. Additionally, as shown in FIG. 5, the blade shuttle 50 may include one or more blade slots 97 in which the blade 55 may be inserted upon coupling with the shuttle 50. In some aspects, the blade slots 97 may apply a frictional force against the blade 55, thereby helping prevent, in part, unwanted removal of the blade 55 from the blade shuttle 50.

Figure 6:
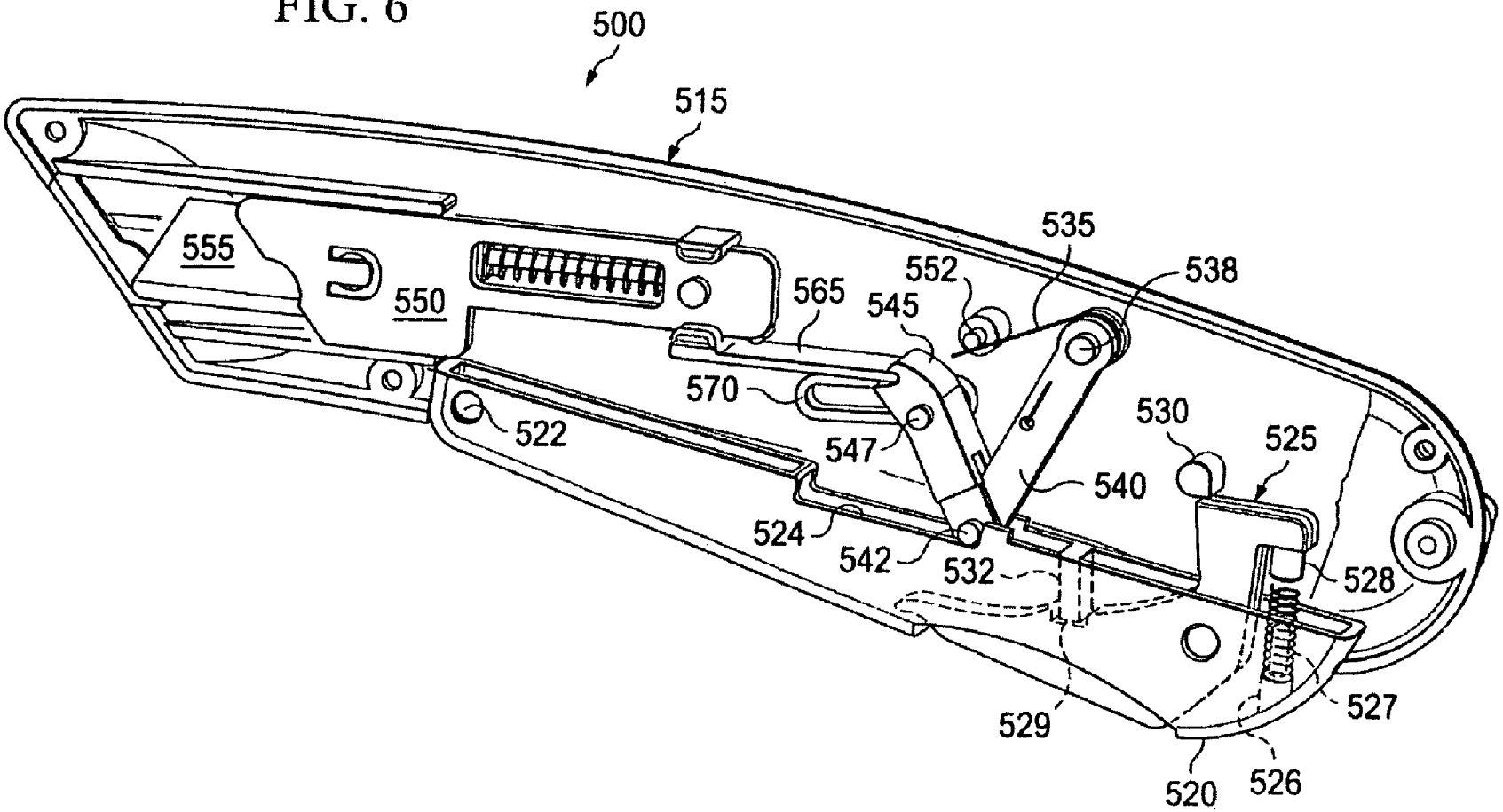
FIG. 6 illustrates one implementation of a trigger lock and blade trigger of a utility cutter according to the present disclosure.

FIG. 6 illustrates one implementation of a trigger lock and blade trigger of a utility cutter 500 according to the present disclosure. In some aspects, the utility cutter 500 may be substantially similar to the utility cutter 10 as described with reference to FIGS. 1 through 4 above. For example, utility cutter 500 includes a handle 515, a blade trigger 520, a trigger lock 525, a stop pin 530, a lever spring 535, a lever 540, a drive arm 545, a blade shuttle 550, and a blade 555, along with additional components as illustrated in FIG. 6. Many components of the utility cutter 500 may be similar or substantially similar to corresponding components of the utility cutter 10.

In some implementations, the utility cutter 500 may include a trigger lock 525, which includes a cylinder 528. The blade trigger 520 may further include a piston 526 attached to or formed integrally with the blade trigger 520. The utility cutter 500 may further include a piston spring 527. Generally, the cylinder 528, the piston 526, and the piston spring 527 may function in concert to return the trigger lock 525 from an unlocked position to a back position when the blade trigger 520 is released from an actuated position. For example, in the unlocked position, the trigger lock 525 may be rotated such that the piston 526 fits into the cylinder 528, thereby compressing the piston spring 527 within the cylinder 528. In a compressive state, the piston spring 527 may apply a force to the trigger lock 525 thereby urging the lock 525 into the back (and locked) position. In another aspect, the piston 526 and the cylinder 528 may be substantially similar in dimensions, such that the piston spring 527 may be compressed between the piston 526 and the cylinder 528 when the trigger lock 525 is in the unlocked position. Alternatively, in other implementations, the piston spring 527 may be integral to the cylinder 528. The piston spring 527, generally, may apply no force to the trigger lock 525 or blade trigger 520 when the trigger lock 525 is in the back position.

FIG. 7 illustrates another implementation of a utility cutter 600 according to the present disclosure. In some aspects, the utility cutter 600 may be substantially similar to the utility cutter 10 as described with reference to FIGS. 1 through 4 and include a clip 605. Clip 605, generally, may provide a user of the cutter 600 a mechanism to attach the cutter 600 to a belt, tool belt, clothing portions, toolbox, or other locations as appropriate during periods of non-use of the cutter 600 and may be coupled to the cutter 600 on either side. The clip 605 may, in some implementations, rotate about an axis perpendicular to the longitudinal dimension of the utility cutter 600 to allow for easier fastening to, for example, the user's belt or clothing. Further, the clip 605 may be detachable from and re-attachable to the cutter 600 as needed.

A number of implementations have been described. Nevertheless, it will be understood that various modifications may be made. Accordingly, other implementations are within the scope of the following claims.

What is claimed is:

1. A knife comprising:

a housing comprising:

a blade aperture;

a trigger aperture; and a stop pin;

a blade connected to a blade shuttle, the blade and blade shuttle substantially enclosed within the housing when the blade shuttle is in a retracted position, the blade extended from the housing when the blade shuttle is in an extended position;

a shuttle spring connected to the blade shuttle and adapted to convey the blade shuttle to the retracted position;

a blade trigger comprising a cavity, the blade trigger pivotally coupled to the housing and accessible at an exterior of the housing through the trigger aperture, the blade shuttle conveyed from the retracted position to the extended position when the blade trigger pivots from a rest position to an engaged position; and a trigger lock comprising a projection, the trigger lock substantially enclosed within the cavity and accessible at the exterior of the housing through the blade trigger, the trigger lock pivotally coupled to the blade trigger, the projection in contact with the stop pin when the blade shuttle is in the retracted position, the blade trigger substantially prevented from pivoting from the rest position to the engaged position when the projection is in contact with the stop pin, the projection released from the stop pin upon rotation of the trigger lock, the blade trigger pivotable from the rest position to the engaged position when the projection is released from the stop pin.

2. The knife as in claim 1, wherein the blade shuttle is adapted to move from the extended position to a cutting position when the blade is engaged in a workpiece, the blade extending further from the blade aperture in the cutting position than in the extended position, the shuttle spring automatically conveying the blade shuttle from the cutting position to the refracted position when the blade is disengaged from the workpiece.

3. The knife of claim 2, wherein the shuttle spring is adapted to automatically convey the blade shuttle from the cutting position to the retracted position when the blade is disengaged from the workpiece when the blade trigger is in the engaged position.

4. The knife as in claim 1, wherein the blade trigger is adapted to pivot from the rest position substantially simultaneous to rotation of the trigger lock.

5. The knife as in claim 1, wherein the blade trigger further comprises a cleft and the trigger lock further comprises a notch, the notch adapted to engage the cleft upon rotation of the trigger lock and transfer rotational motion from the trigger lock to the blade trigger, the blade trigger adapted to rotate from the rest position to the engaged position when the notch engages the cleft.

6. The knife of claim 1 further comprising a transmission adapted to transfer a rotational force of the blade trigger as it rotates from the rest position to the engaged position to a lateral force, the lateral force directed to convey the blade shuttle from the retracted position to the extended position.

7. The knife of claim 6, wherein the blade shuttle comprises a spring tongue and the blade trigger further comprises a rail, the transmission comprising:

at least one guide integrally formed in an interior surface of the housing;

a lever coupled to the housing, the lever comprising at least one lever pin adapted to move along the rail as the blade trigger rotates from the rest position; and a drive arm coupled to the lever, the drive arm comprising a pin and a notch, the pin adapted to engage the guide and slide within the guide when the blade trigger rotates from the rest position, the notch adapted to engage the spring tongue when the blade trigger rotates from the rest position, the notch adapted to convey the blade shuttle from the retracted position to the extended position when the blade trigger rotates from the rest position to the engaged position.

8. The knife of claim 7 further comprising:

a spring post integral to the housing, the lever coupled to the housing via the spring post; and a lever spring coupled to the spring post and the lever, the lever spring adapted to apply a torsional force to the lever and convey the blade trigger from the engaged position to the rest position via the transmission.

9. The knife of claim 7, the spring tongue adapted to bend while engaged with the notch when the blade shuttle moves from the retracted position to the extended position, the spring tongue adapted to disengage from the notch when the blade shuttle moves from the extended position to a cutting position.

10. The knife of claim 7, wherein an angle between the drive arm and the lever is between approximately 70 degrees and approximately 90 degrees.

11. The knife of claim 1, wherein the shuttle spring exerts no force on the blade shuttle when the blade shuttle is in the retracted position.

12. The knife of claim 1 further comprising a trigger spring, the trigger lock in a locked position when the projection is in contact with the stop pin, the trigger lock in an unlocked position when the projection is released from the stop pin, the trigger spring urging the trigger lock from the unlocked position to the locked position.

13. The knife of claim 12, wherein the trigger spring is an integral spring extension of the trigger lock.

14. The knife of claim 12, wherein the trigger spring comprises a compression spring coupled to one of the trigger lock or the blade trigger.

15. The knife of claim 12, wherein the trigger lock is adapted to receive a compressive force to convey the trigger lock from the locked position to the unlocked position, the blade trigger adapted to receive the compressive force to convey the blade trigger from the rest position to the engaged position.

16. The knife of claim 1 further comprising a clip coupled to the housing.

17. The knife of claim 1, wherein the housing further comprises:

a front housing edge at the blade aperture, wherein a first obtuse angle is defined between a cutting edge of the blade and the front housing edge; and a front contour, wherein a second obtuse angle is defined between the blade extended from the housing when the blade shuttle is in an extended position and the front contour, the first obtuse angle and the second obtuse angle defining a compound angle of cut.

18. The knife of claim 1, wherein the blade trigger comprises a front portion and a back portion, the front portion nearest the blade aperture, the front and back portions each defining approximately one-half a length of the blade trigger, the trigger lock accessible at the exterior of the housing through the back portion of the blade trigger.

19. The knife of claim 1, wherein the blade comprises a mount hole and the blade shuttle comprises an integral detent formed in a blade slot, the blade adapted to slide into the blade slot and engage the integral detent with the mount hole.

20. The knife of claim 19, wherein the integral detent comprises a leading edge and a back edge, the leading edge tapered from a base of the detent to a top of the detent, the back edge substantially perpendicular to the blade shuttle, the blade adapted to engage the integral detent with the mount hole over the leading edge, the back edge adapted to substantially prevent decoupling of the blade from the blade shuttle.

* * * * *